US006283434B1

(12) United States Patent
Holder

(10) Patent No.: US 6,283,434 B1
(45) Date of Patent: Sep. 4, 2001

(54) SUPPORT ELEMENT AND DEVICE FOR HOOKING AND POSITIONING PAINTING OR THE LIKE

(76) Inventor: Philippe Holder, 123, Passage du Port, 83990 Saint-Tropez (FR)

( * ) Notice: Subject to any disclaimer, the term of this patent is extended or adjusted under 35 U.S.C. 154(b) by 0 days.

(21) Appl. No.: 09/029,128

(22) PCT Filed: Aug. 28, 1996

(86) PCT No.: PCT/FR96/01325

§ 371 Date: Feb. 24, 1998

§ 102(e) Date: Feb. 24, 1998

(87) PCT Pub. No.: WO97/07720

PCT Pub. Date: Mar. 6, 1997

(30) Foreign Application Priority Data

Aug. 29, 1995 (FR) ..... 95 10360
Mar. 19, 1996 (FR) ..... 96 03648

(51) Int. Cl.[7] ..... A47G 1/24
(52) U.S. Cl. ..... 248/495; 248/489
(58) Field of Search ..... 248/495, 475.1, 248/476, 489, 490, 467, 466; 40/713, 745, 757

(56) References Cited

U.S. PATENT DOCUMENTS

| | | | | |
|---|---|---|---|---|
| 368,251 | | 8/1887 | Stuebner . | |
| 681,380 | * | 8/1901 | Turner | 248/495 |
| 2,474,626 | | 6/1949 | Gunning | 145/50 |
| 2,509,424 | | 5/1950 | Denton | 248/31 |
| 2,522,901 | | 9/1950 | Schrager et al. | 248/31 |
| 2,697,572 | | 12/1954 | Pfankuch | 248/31 |
| 2,723,096 | * | 11/1955 | Schwartz | 248/495 |
| 2,791,388 | | 5/1957 | Hirt | 248/31 |
| 2,940,712 | | 6/1960 | Lloyd-Young | 248/205 |
| 2,965,339 | | 12/1960 | Denton | 248/28 |
| 2,981,506 | * | 4/1961 | Saslow | 248/495 |
| 2,983,473 | | 5/1961 | Waller et al. | 248/31 |
| 3,188,028 | * | 6/1965 | Waller | 248/489 |
| 3,376,911 | | 4/1968 | Henning | 151/41.73 |
| 3,878,756 | | 4/1975 | Hallock | 85/23 |
| 4,566,665 | * | 1/1986 | Rynearson | 248/495 |
| 4,892,284 | * | 1/1990 | Kelrick | 248/476 |
| 4,988,249 | | 1/1991 | Kardefeldt et al. | 411/513 |
| 5,103,573 | | 4/1992 | Ehling et al. | 33/613 |

FOREIGN PATENT DOCUMENTS

| | | |
|---|---|---|
| 0090780 | 10/1983 | (EP) . |
| 0479182 | 4/1992 | (EP) . |
| 264933 | 1/1927 | (GB) . |
| 1347058 | 2/1974 | (GB) . |

* cited by examiner

*Primary Examiner*—Anita M. King
(74) *Attorney, Agent, or Firm*—Ladas and Parry

(57) ABSTRACT

An apparatus for hanging an object including a device that has (i) a body with a threaded passage that passes through the body; (ii) a member for fixing the body to a substantially vertical surface; (iii) a bracket element for supporting a protruding surface of the object; and (iv) a threaded adjustment member inserted into the passage and movable with respect to the body for displacement of the protruding surface relative to the body and for supporting the protruding surface relative to the body in any of a plurality of positions. The adjustment member has a first end that protrudes from a top face of the body and a second end that protrudes from a bottom face of the body. In one embodiment, the bracket element tapers to a point. In another embodiment it has a generally planar surface.

19 Claims, 11 Drawing Sheets

SUPPORT ELEMENT AND DEVICE FOR HOOKING AND POSITIONING PAINTING OR THE LIKE

FIELD OF THE INVENTION

The invention relates to a support element and to a device for supporting and positioning a painting on a wall.

BACKGROUND OF INVENTION

When it is desired to hook a painting or a similar flat object such as a mirror on a wall, a cord joining the two uprights of the frame of the painting must generally firstly be fixed, or one or more rings must be fixed at the rear of the painting. The painting is then hung via this cord or this or these rings, on one or more support elements fixed in the wall, for example nails, plugs or hooks such as the one described in U.S. Pat. No. 2,940,712. This document describes a hook provided with a nail presenting a "V" shaped body which comprises a notched slot, as well as a tapering point and a head: a second threaded anchoring nail (or screw) extends through the notched slot; the first nail is inclined upwardly by an angle ranging from 35 to 45° with respect to the horizontal, while the second (anchoring) nail is inclined downwardly.

It is difficult to manage to position the painting precisely. In fact, when several support elements are used, unimportant variations in alignment may nonetheless provoke an inclined position of the painting detrimental to its aesthetic appearance and to the general presentation of the wall. When a single support element is used, the painting is then in even more precarious equilibrium, and may pivot accidentally due to the cord sliding around its single point of support, and take a considerably inclined position.

Furthermore, if it is desired to modify the position of the painting in height, it is necessary either to fix a new support element in the wall, or modify the length of the cord, which process is fastidious.

U.S. Pat. No. 2,791,388 discloses a device for supporting and positioning a painting, which comprises:

- a support comprising two lugs, to be fixed to the wall by nails, screws or an adhesive, and comprising a threaded opening;
- a body likewise comprising two lugs to be fixed to the frame by fixing members such as nails screws or adhesive,
- two threaded rods fixed to the body and provided with a nut,
- a base which may slide horizontally with respect to the support to allow a horizontal displacement of the frame.

SUMMARY OF THE INVENTION

One object of the invention is to propose a system for hooking the painting to the walls by its frame which is improved.

Another object of the invention is to propose a system for fixing a painting which is very simple and very easy to use.

One purpose of the invention is to provide a support element and a device for supporting and positioning a painting on a wall which overcomes the drawbacks mentioned hereinabove and allows an easy and rapid installation on a wall of any material and, an easy and precise positioning of the painting on the wall, as well as an efficient support of this painting without damaging the wall.

One purpose of the invention is to provide a support element and a supporting and positioning device which makes it possible to modify the position of the painting both horizontally and vertically, so that the painting integrates perfectly in its visual environment.

According to a first aspect, the invention consists in providing a support for hooking a painting, which comprises an element forming intermediate support to be fixed to the wall (by one or more means such as nails or screws), and an element forming a bracket adjustable in height with respect to said member and fixed thereto; when the element forming bracket is fixed to the intermediate support element which is fixed to the wall, the bracket projects on the wall and supports the object (such as the frame of the painting) by one of its substantially horizontal, so-called hanging faces or parts of the painting, which is protuberant with respect to the rear face of the painting, and which extends in a zone of the painting located above the center of gravity of the painting; the painting is thus hung by its said hanging face (forming for example part of an upper crossbeam of its frame) which abuts on the bracket; anti-slide means are generally necessary in order to avoid a movement of slide of the hanging face of the frame on the corresponding abutment face of the bracket.

An important advantage of the invention is that no fixing element is added to the painting since a hanging face integrated therein is used.

According to preferred embodiments:

- said supporting and positioning device (for hooking or hanging) a flat object provided with a protuberant element on its rear face, on a substantially vertical surface, comprises:
- an intermediate fixing body or element which comprises a threaded passage (or tapped hole),
- means for fixing to said wall (to said surface) said intermediate fixing body or element,
- an element for positioning (or adjustment) or vertical displacement and support of said object or painting, which comprises:
  - a central threaded part (or rod) which is adapted to extend through (and to cooperate with) said threaded passage, in order to be screwed or unscrewed over a stroke of at least 10 millimeters (for example from 20 to 30 mm),
  - a first end part (or lower end) which comprises a means for actuating said central threaded part in rotation, i.e. for screwing or unscrewing in said threaded passage,
  - a second end part (or upper end) which comprises a bracket element (on which may abut a substantially horizontal plane zone or face of said protuberant element of said frame of said object or painting, which is disposed in the upper part of said object, which first and second end parts are disposed on either side of said central part);
- said element forming bracket (of said second end part) comprises on an upper horizontal bearing face, on which said frame may be hanged by its said horizontal plane face or zone, which comprises friction or friction or adhesion means adapted to cooperate with said hanging face of said frame, which means preferably comprise one or more (preferably tapered conical or pyramidal) tacks or brads adapted to penetrate at least partly (by marking or stamping) in said hanging face of said frame made of a material of low hardness, such as wood or a plastics material;

said body comprises at least one through hole (preferably two) or slot, extending between front face and rear face of the block, adapted to receive a curved metal blade forming one of said means for fixing said body to said surface, which blade is preferably essentially constituted by a portion of bent or rolled metal plate (or foil or thin section), which through hole or slot is substantially cylindrical, of circular section or not;

said body comprises at least two (preferably at least four) guiding through holes or slots, extending between front face and rear face of the block, adapted to receive at least two different means (for example three different means) for fixing said body to said surface;

said body is provided with two parallel, principal, large faces: a rear face in contact with the surface and a front face by which the fixing means are introduced in said holes or slots;

said holes or slots, as well as the lower and tipper faces of the body, are inclined with respect to the normal to a rear face for abutment of the body against said surface, by an angle included between 5 and 45 degrees, preferably ranging from 15 to 35 degrees, for example close to 20 to 30 degrees;

said device comprises a face for abutment against said surface for example integrated in said intermediate fixing body or element, which is adhesive;

said device further comprises a base or interposed adapter of flattened shape, for example in the general form of a shoe, which comprises integrated means for mechanical fixing or connection with said intermediate fixing body or element, which comprises a rear face in contact with said surface (whose surface is larger than the various surfaces of the faces of said body), which is coated with an adhesive, and said interposed piece or adapter further preferably comprises at least one and preferably at least two through orifices for guiding accessory means (such as tacks or nails) for fixing said adapter to said surface, which means for mechanical connection with said intermediate fixing body or element preferably comprise at least one slide element (male or female respectively) adapted to cooperate with a slide element (female or male respectively) with which said intermediate fixing body or element is provided, which adapter further comprises at least one stop;

said intermediate fixing body or element is made of plastics material;

said positioning or displacement and supporting element is essentially constituted by a screw, made of plastics material or metal, provided with a tapering point;

said intermediate fixing body or element is in the form of a cylindrical portion, of rounded rectangular section for example, preferably oblique, i.e. of which the axis of the cylinder is inclined with respect to the base, which axis is preferably parallel to the axes of said tack, blade and screw housings;

the device comprises at least two blades of the same section (or profile) and of different length, and/or comprises at least two blades of section of the same shape (or profile) and of different width.

The positioning and supporting element is advantageously constituted by a threaded rod traversing a threaded bore of the intermediate fixing element on either side, the threaded rod being of length greater than the height of the fixing element, and being provided at its lower end with an actuation means; the threaded rod may be equipped at its tipper end with a support part forming bracket, which is then advantageously mounted to rotate freely on the threaded rod in a plane parallel to the wall.

One advantage of the invention is the provision of a system for fixing a painting which is adapted to frames or paintings of small dimensions, for example whose length is of the order of 20 cm, as well as to frames, paintings or objects of large dimensions, for example of length greater than or equal to one meter.

Another advantage of the invention is the provision of a system for hanging on the wall objects such as paintings of high mass, particularly whose mass is greater than ten kilos.

A further advantage of the invention is the provision of a system for hanging paintings which is adapted to walls or surfaces of different nature (wood, plaster, brick, stone, concrete, in particular) and of different thicknesses.

A still further advantage of the invention is the provision of a system for hanging a painting which makes it possible to incline (to a certain extent) the painting with respect to the wall.

The invention also provides a system composed of one or more device(s) according to the invention to which may be added one or more of the following hanging tools or accessories:

a tool for adjusting by screwing or unscrewing the screw bearing the bracket;

a removable rectilinear positioning rule provided on a lower face with at least two housings for insertion of the upper ends of the threaded rods, these housings being of the same depth, with a view to adjusting to the horizontal the ends of the threaded rods; these housings are bored and present a thread corresponding to that of the threaded rods.

The adjusting tool formed by a rod comprising a handle at one of its ends and at a second end, an actuation means complementary of that of the positioning and support element.

The rod of the adjusting tool is in that case advantageously made of a flexible material.

The end of the rod of the adjusting tool comprising the actuation means preferably also comprises two elastic jaws for temporarily holding the actuation means complementary of the adjusting tool and of the positioning and support element in mesh one with the other.

The invention also provides a tool for hanging and/or assisting in fixing a flat object such as a painting against a vertical surface such as a wall by fixing means such as nails, screws or blades which comprises:

a first bar elongated along a first longitudinal axis, as the case may be, a second bar elongated along a second longitudinal axis perpendicular to said first axis, preferably mounted to slide along its longitudinal axis with respect to said first bar, and comprising distance measuring graduations, which first bar comprises:

a substantially plane rear face adapted to be applied against the outer face of said surface, at least one (preferably several) first cavity (cavities) adapted to receive at least a portion of an intermediate body or element for fixing (the painting), and with a thickness or depth such that said body may be housed at least partly in said first cavity with its rear face substantially flush with the rear face of the first bar, which first cavity opens out on a front face of the first bar via an orifice allowing free passage and slide of said means for fixing the body, for impacting them in said wall, at least one (preferably several) second cavity (cavities) adapted to receive at least a portion of an element (such as a screw) for positioning and supporting (the painting) which is screwed in said intermediate fixing element, which second cavity communicates with said first cavity and preferably extends along a longitudinal axis perpendicular to said longitudinal axis of the first bar, which second cavity opens out on a lower face as well as on an upper face of said first bar.

Another object of the invention is to provide a system for fixing objects on walls made of plaster more particularly, or of materials of low resistance to penetration; at the present time, there is no rapid means, which does not spoil the walls, for fixing an object such as a relatively heavy painting on a plaster wall whose thickness is less than 10 mm. Moreover, all the existing systems leave considerable traces in the wall and people are reluctant to spoil their walls.

According to another aspect, the invention provides a member for fixing an object to a surface of slight hardness, constituted by a metal blade incurved transversely, preferably bent, to increase its rigidity.

One or more metal blades serve to fix on the wall one or more parts which themselves serve to support an object. The parts fixed on the wall with the aid of metal blades comprise one or more slots. These slots have the same shape as the metal blades. The metal blades forming a sort of headless nail slide in the slots when they are driven in the wall, particularly with the aid of a hammer.

These blades ensure a considerable resistance to tear while avoiding spoiling the walls in which they are driven. To that end, these blades are made of steel and are of very small thickness, viz. generally from 0.1 to 0.7 mm, preferably from 0.2 to 0.4 mm.

In these thicknesses, these blades thus do not leave visible traces when they are withdrawn from a wall. However, for a blade of such fineness to be able to present a considerable shear and/or bending strength, it is indispensable that it has a shape which gives it this aptitude.

Furthermore, this blade must also have mechanical characteristics and in particularly of rigidity, which enable it to be driven in the wall where it is desired to fix it, with the aid of a hammer.

In order considerably to increase its rigidity, the incurved shape may be obtained by bending the blade through an angle preferably close to 90° along a line parallel to its longiudinal axis. The apex of the angle of bend will have a sufficient radius of curvature to avoid breaking the blade during bending; in fact, in the preferred case of the metal employed being blued steel sheet, the latter would break upon bending if the angle at the apex were too acute. This technique is employed to reduce the manufacturing costs which would be generated by using a metal that would have to be tempered after bending in order to increase the hardness.

The blade may take all sorts of shapes capable of increasing its rigidity. This shape may be partly or entirely circular, or possibly undulated.

For this blade to withstand the efforts resulting from the impacts of the hammer used for driving it in the wall, despite its bending described above, it will preferably be guided by the part which it serves to fix on the wall or by a guiding tool.

In fact, the part that the blade serves to fix against the wall may serve to some extent as drill or guide bushing; the blade will slide inside this part which will have housings of the same shape as the blade, in transverse section, and will enable it to slide inside while being perfectly guided. When the blade penetrates in the wall, on driving in, it will make its housing itself, which will be only the extension of the guiding housing, in which it slides, which is provided in the part that it fixes to the wall.

As the radius and angle of curvature of the transverse section of the housing will be respectively identical to the radius and angle of curvature of the transverse section of the blade, it will be possible to slide in the housing a blade whose width is smaller than the width of the housing (slot), the blade being guided by its apex (or cured part) cooperating with the corresponding curved part of the housing (or slot).

In this way, the maximum mechanical shear strength may be obtained both by the shape of the blade and by the fact that this shape will reflect both in the fixing piece and in the wall; the rigidity obtained by the shape of the blade and the guiding of the blade inside the piece for fixing on the wall, will facilitate penetration of said blade in the wall when it is driven in with a hammer.

The bending of the blade at an angle will enable it to be guided by its apex; similarly, if the blade has an undulating shape, it will also be guided and rigidifled. This will make it possible to propose blades of different dimensions as a function of the weight to be supported.

The blade will not have to penetrate a great deal in the wall to ensure considerable shear strength. Such strength will be ensured by the surface of anchoring in the wall, generated by the shape of the blade.

In fact, a blade presenting a width of about 10 mm (opened out) and penetrating in the wall by a depth of 4 mm, makes it possible to obtain an anchoring surface of 40 $mm^2$, which is important and makes it possible to support a consequent weight. If the blade is wider and penetrates even more deeply in the wall, it will obviously make it possible to support even greater loads.

Said blade is obtained by cut-out and defonation (preferably bending or rolling) of a thin metal plate, i.e. whose thickness is included between ($10^{-4}$) and 7($10^{-4}$) meters, preferably from 2($10^{-4}$) to 4($10^{-4}$) meters.

The ratio of the smallest radius of curvature with respect to the thickness of the blade is preferably greater than 3, preferably ranging from 5 to 50; the ratio of the largest transverse dimension (or width) with respect to the thickness is at least equal to 10 and preferably less than 150, for example close to 50; the ratio of the length of said blade with respect to its largest transverse dimension (or width) is at least equal to 1.5, preferably of the order of about 2 to 5.

BRIEF DESCRIPTION OF THE DRAWINGS

The invention will be more readily understood on reading the description of an embodiment of a device according to the invention for supporting and positioning a painting, made with reference to the accompanying drawings, in which:

FIGS. 12, 13, 14, 15 are respective views in transverse section of FIGS. 12A, 13A, 14A, 15A which illustrate in schematic perspective view preferred embodiments of blades according to the invention.

DETAILED DESCRIPTION

Unless indicated to the contrary, structurally or functionally identical or similar elements are designated in the Figures by identical references.

Unless indicated to the contrary, the terms "front", "rear", "upper", and "lower" are used with reference to a user observing the devices of the invention in their situation of use.

Figure 19:
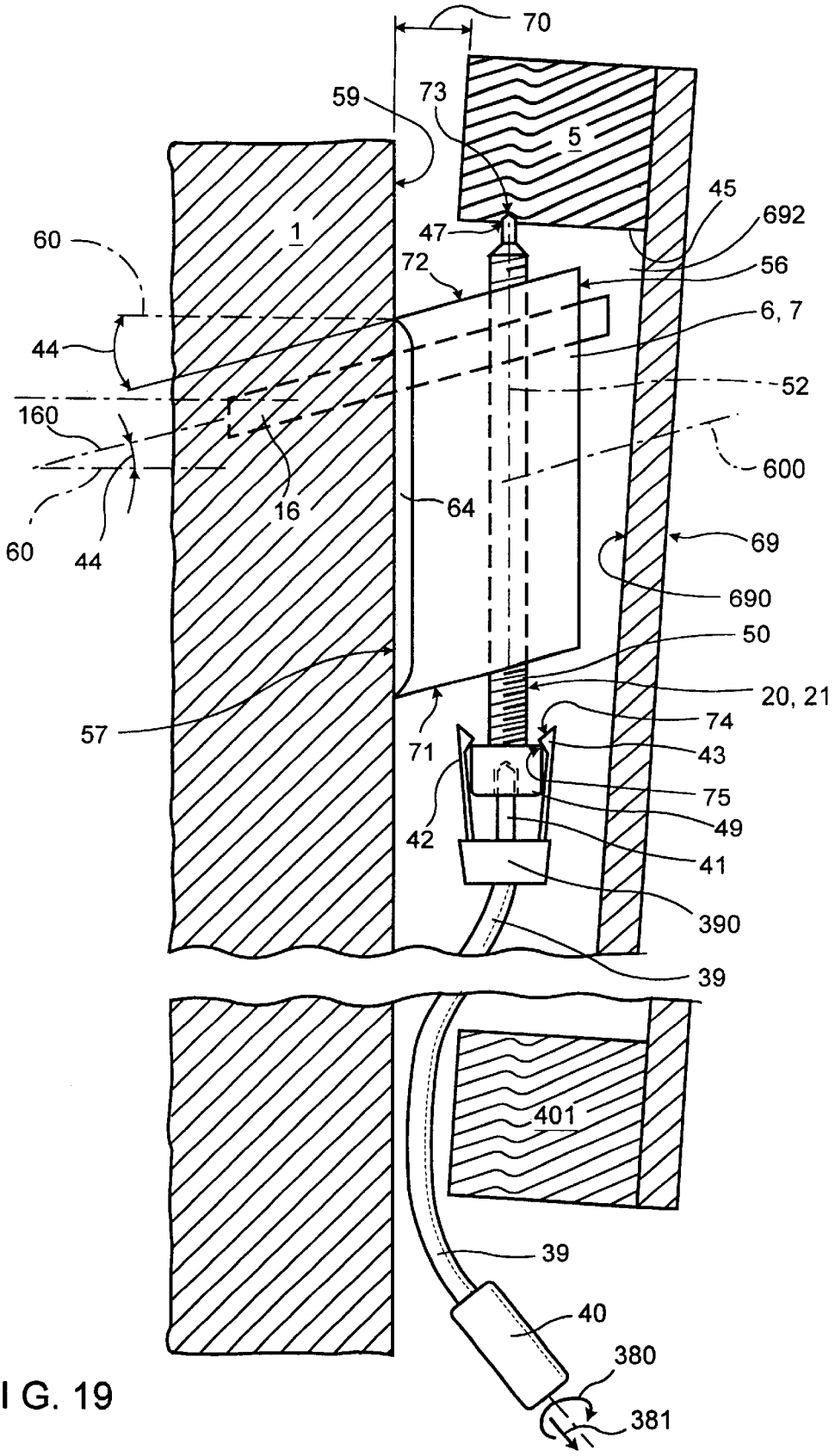
FIG. 19 is a side view along XIX of FIG. 17.

The system for supporting a painting on a wall (1 shown in FIGS. 3, 4, 5, 16 and 1:) comprises two supporting devices, left-hand 2 and right-hand 3, supporting a picture frame 4, which frame is essentially constituted by an upper horizontal beam 5 (for example constituted by a strip of wood of rectangular section, as illustrated in FIG. 19), a lower horizontal beam 401 and two vertical beams 400 and 402 connecting beams 5 and 401.

Figure 1:
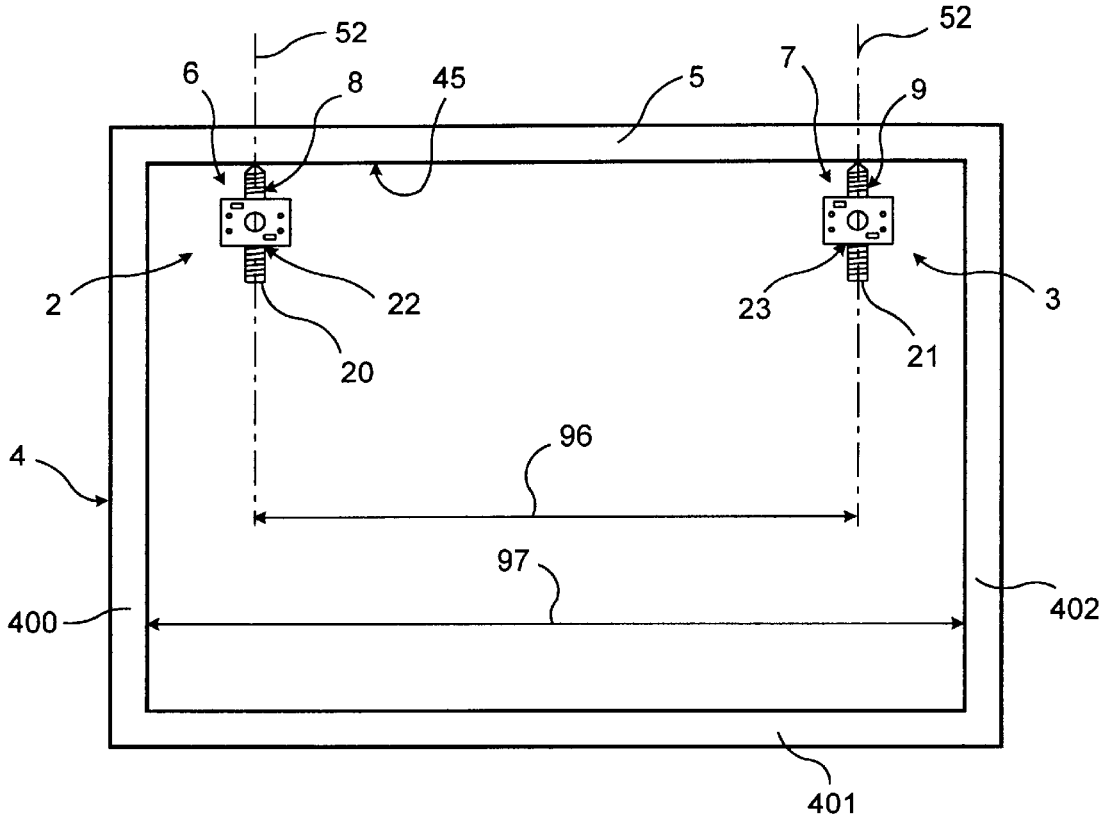
FIG. 1 is a front view of the device according to the invention supporting a picture frame.
Figure 6:
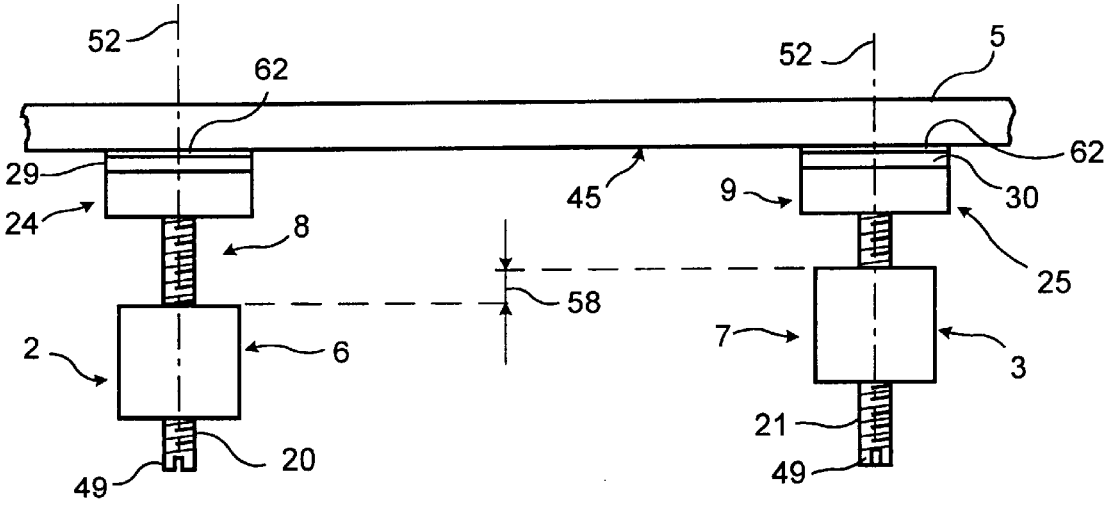
FIG. 6 is a front view of the device according to the invention supporting a beam of a picture frame, in a first variant embodiment.
Figure 17:
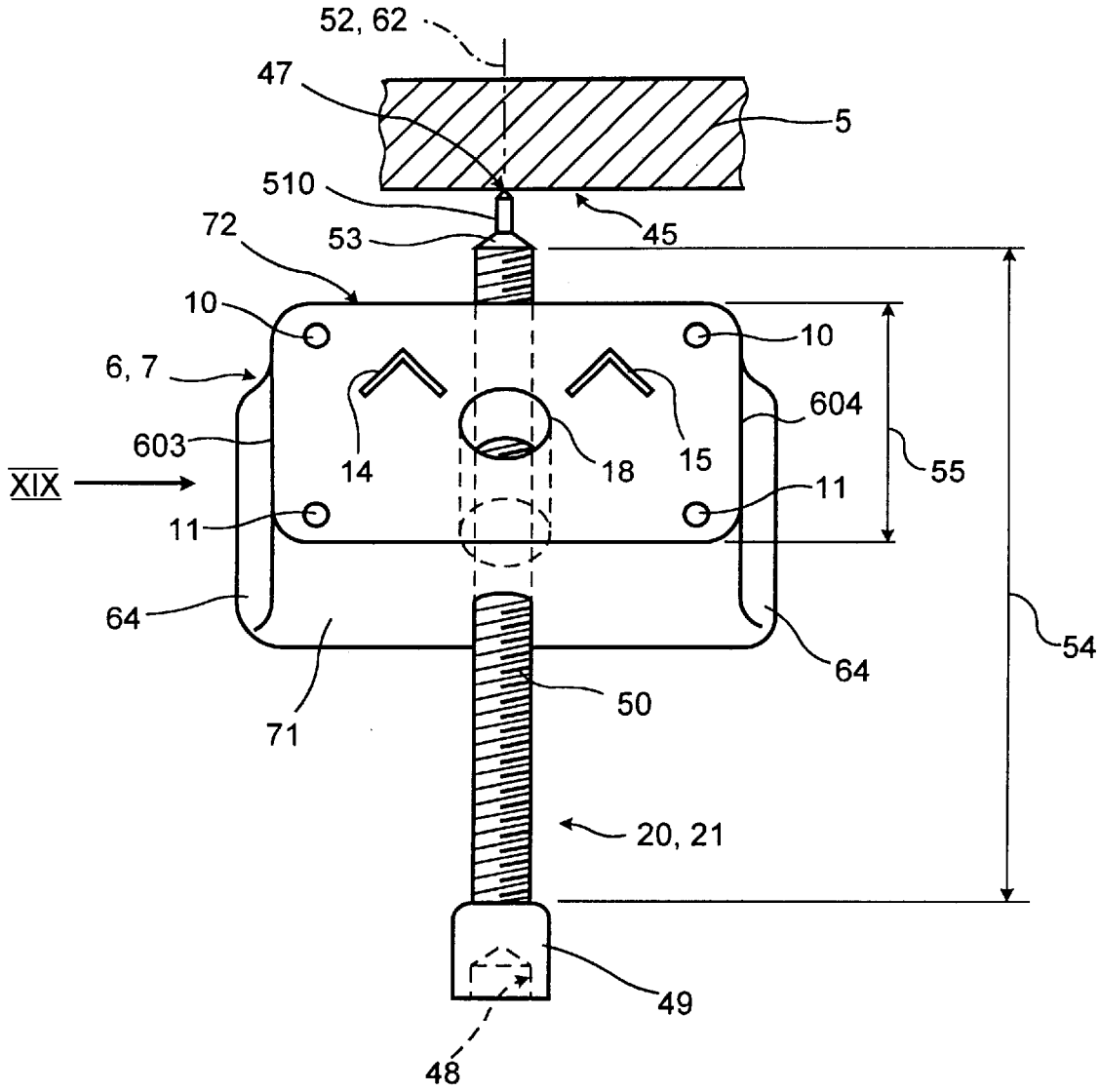
FIG. 17 illustrates in a front view a preferred embodiment of a block serving as intermediate support and displacement screw and forming bracket for the suspension of a frame of a painting.

It is specified that the frame of the painting is shown without a canvas in FIGS. 1, 6 and 17 in order to show the supporting and positioning devices.

Each supporting device 2 or 3 is composed of an intermediate element 6, 7 for fixing on the wall, and by a positioning and supporting element 8, 9 which is mounted mobile on the fixing element 6, 7 and which is adjustable in height.

In the embodiment illustrated in FIGS. 1 to 5, the element 8, 9 is constituted by a headless screw with cylindrical thread in its central part 50, i.e. a threaded rod 20, 21 whose lower end 49 comprises a recessed impression 48 for driving the screw in rotation about its longitudinal axis 52 which, in position of use, is substantially vertical, which screw comprises at its upper end 51 a conical shaft part 53 terminating in a point 47 forming a bracket for abutment of the lower face 45 (so-called hanging face) of the crossbeam 5 of the frame 4.

The fixing element 6, 7 is constituted by a block of generally parallelepipedic shape, and is provided with fixing means to fix it on the wall 1, which are here constituted both by bores 10, 11 for the passage of nails 12, 13 or screws, by slots 14, 15 for the passage of blades 16, 17, and by a hole (or cavity) 18 for the passage of a screw 19, which is intended to be screwed in a plug 46 previously inserted in the wall 1 through the element 6.

The body (or intermediate element) 6, 7 is provided with two principal faces parallel to each other: a rear face 57 which is applied against the outer face 59 of the wall, and a front face 56 by which fixing means (screw, blade, nail) are introduced in their respective housing (10, 11, 14, 15, 18).

The hole 18 presents a smaller diameter at its end opening on the rear face 57, adjacent the wall, than at its end opening on the front face 56 opposite the wall; this narrowed part of the hole 18 serves as stop or shoulder for the head of the screw 19.

Figure 3:
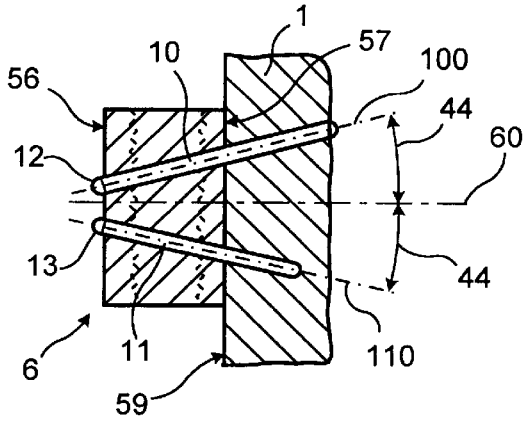
FIG. 3 is a side view in section along line III—III of FIG. 2, of an element for fixing the supporting member, showing a first mode of fixation.
Figure 4:
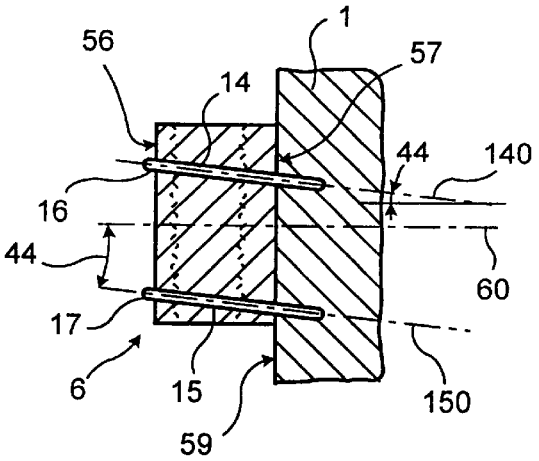
FIG. 4 is a side view in section along line IV—IV of FIG. 2, of the fixing element, showing a second mode of fixation.

It will be noted in FIG. 3 that the bores 10, 11 (of respective longitudinal axis 100, 110) for the nails 12, 13 or the screws are not parallel, which makes it possible to prevent tear of the fixing element 6, 7 once it has been placed in position.

However, the slots 14, 15 (of respective longitudinal axis 140 and 150) for the blades 16, 17 are preferably inclined downwardly in the direction of penetration of the blades 16, 17 by an angle 44 with respect to the horizontal, i.e. with respect to the normal 60 to the outer face 59 of the wall 1 (FIG. 4), which is preferably common (and identical) to the slots and to the bores 10, 11 (which are therefore parallel) and for example close to 15 degrees. In this way, the blades and the nails ensure a hold and a very satisfactory tear strength.

Figure 2:
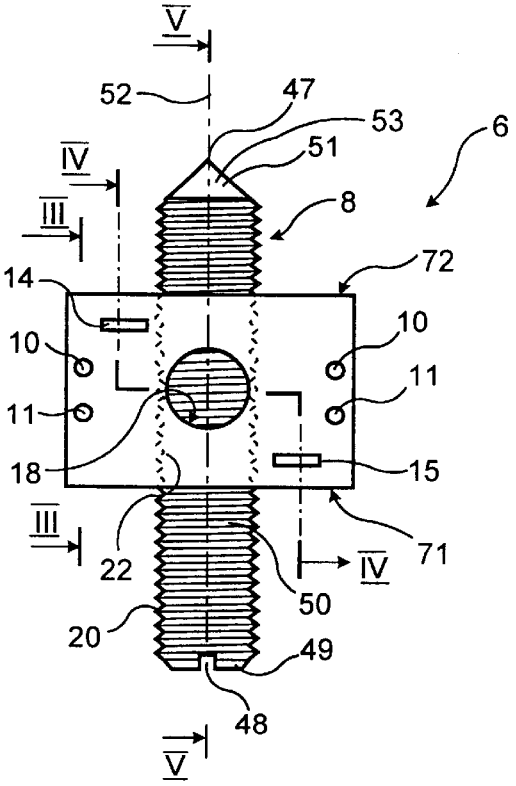
FIG. 2 is a front view of a member for supporting the device of FIG. 1.
Figure 5:
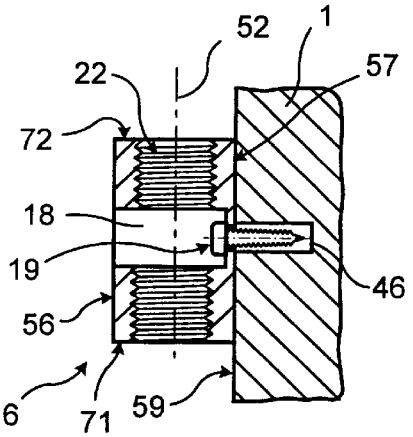
FIG. 5 is a side view in section, along line V—V of FIG. 2, of the fixing element, showing a third mode of fixation.

With reference to FIGS. 2 and 5 in particular, the block or body forming intermediate support 6 is furthermore pierced with a tapped hole 22 of axis 52 (vertical when the block 6 is in position of use), which passes right through and opens out both on the upper face 72 of the block 6 and on its lower face 71; as the tapped hole 22 traverses the hole (or cavity) 18 serving for passage of the screw 19, the latter must be inserted in the hole 18 before the positioning and supporting screw 8, 9 is placed in position in the intermediate fixing element 6, 7; when said element 6, 7 is fixed by said screw 19 which occupies a substantially central part of the block 6 as shown in FIG. 2 in particular, it is desirable to provide on the rear face 57 of the block intended to be applied against the face 59 of the wall, an adhesive or other anti-slide means such as a rough part for example, constituted by a portion of paper coated with abrasive, in order to prevent rotation about the axis of the screw 19 of the block 6 with respect to the wall, when said screw 19 is tightened.

Each positioning and supporting element 8, 9 is therefore constituted by a threaded rod 20, 21, which is inserted in a threaded bore 22, 23 pierced in the upper face of the fixing element 6, 7 and which is provided with a means for actuation in rotation which may for example be a wheel, with a view to manual actuation, or a diametrical slot, or a stud, with a view to actuation by an adjusting tool such as a screwdriver, a spanner; the threaded bore 22, 23 and the threaded rod 20, 21 pass right through the fixing element 6, 7.

The upper conical (pointed) end of each threaded rod 20, 21 constitutes a point of support of the frame 4 of the painting.

When it is desired to hook a painting on the wall, the two fixing elements 6, 7 are firstly fixed on the wall 1, with the aid of one or more of the fixing means such as nails 12, 13, blades 16, 17, screw 19. A precise positioning of the fixing element 6, 7 on the wall is not essential. Their horizontal spacing (96, FIG. 1) must, however, be less than the width (97, FIG. 1) of the painting, and the difference of their positions in height (reference 58, FIG. 6) must not be greater than the extent of the adjustment in height of the positioning and supporting screws 8, 9, in order then to allow an adjustment to an identical dimension of the points or faces (47 and 28, FIGS. 7 and 8) forming supporting bracket; this is rendered possible in the case of the screws 20, 21 for vertical adjustment traversing the intermediate fixing body 6, 7 (as in the case of FIGS. 1 to 5 and 17 in particular), by providing that the length of the central threaded part 50 of the screw 20, 21 is clearly greater than (for example close to at least double) the height of the block 6, 7 measured between its lower (71) and upper (72) faces respectively, so that the difference between these dimensions defines a stroke in vertical translation along axis 52 of the screw 20, 21 with respect to the block, sufficient to allow such adjustment.

This characteristic makes it possible to fix the fixing elements 6, 7 very rapidly, without having to verify the horizontal orientation by fastidious and time consuming measurements beforehand. It also makes it possible to adapt to unequal or heterogeneous walls.

The frame 4 of the painting is then hung by the lower face 45 of its upper horizontal beam 5 on the pointed ends 47 of the threaded rods 20, 21. If the painting is not horizontal, i.e. if the upper ends of the threaded rods 20, 21 do not lie on a horizontal line, one or the other threaded rod 20, 21 may then be rotated until the desired horizontal orientation is obtained. To that end, where necessary, a tool incorporating an elongated rod is used, making it possible to attain the actuation means at the lower end of the threaded rods from the bottom of the painting (passing behind it as illustrated in FIG. 19), for example a screw driver with elongated blade.

The device according to the invention may be used for supporting and positioning paintings of rectangular shape or not, for example diamond-shaped, circular, etc.

Figure 7:
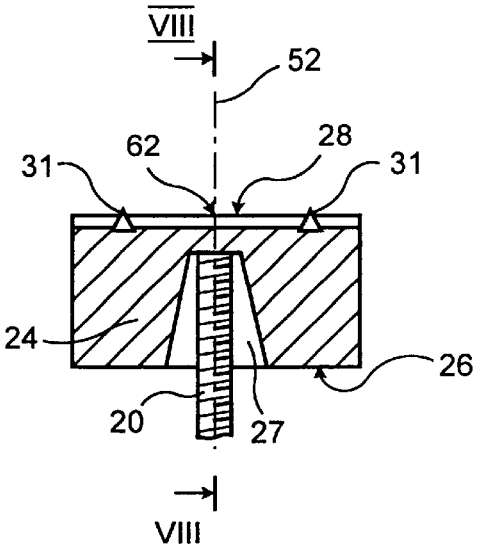
FIG. 7 is a front view in section, along line VII—VII of FIG. 8, of a part for supporting the device of FIG. 6.
Figure 8:
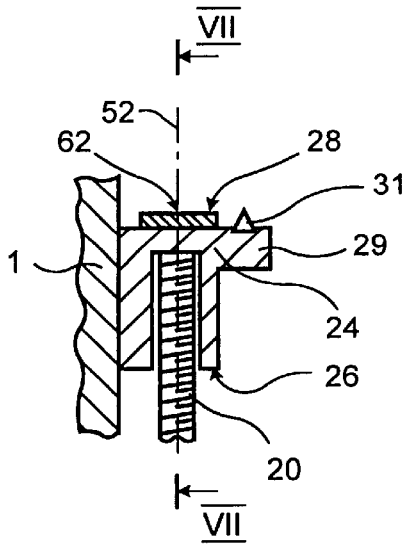
FIG. 8 is a side view in section, along line VIII—VIII of FIG. 7, of the supporting part.

FIGS. 6 to 8 show the supporting device according to the invention in a variant embodiment in which the positioning and supporting elements 8, 9 comprise an additional supporting part 24, 25 as a bracket for the picture frame, which is mounted on the tipper end of the threaded rod 20, 21; this part 24 or 25 presents a lower face 26 provided with an orifice 27 for receiving the upper end of the threaded rod 20 or 21, and an upper face 28 acting as bracket for supporting the upper horizontal beam 5 of the picture frame 4.

The supporting part 24 or 25 presents a flange 29, 30 projecting from the side opposite the wall. In this way, by placing the upper beam 5 of the frame 4 on the flanges 29, 30, it is possible to separate the top of the painting from the wall somewhat, so as to give it an inclination (reference 70, FIG. 19) with respect to the vertical face 59 of the wall.

The orifice 27 for receiving the threaded rod 20 or 21 presents a downwardly flared shape, at least in the direction parallel to the wall, as shown in FIG. 7, in order that the supporting parts 24, 25 are inclinable in a plane parallel to the wall. In this way, the upper faces 28 of the two supporting parts 24, 25 may remain aligned in the course of adjustment and positioning; said upper face 28 is provided with tacks 31 and/or an adhesive tape 62 facilitating the support and hold of the picture frame 4. These tacks are intended to penetrate in the upper beam of the picture frame, which is generally made of wood, provoking a slight deformation (reference 73, FIG. 19) of the hanging face 45 of the crossbeam 5; these anti-slide means 31, 62 allow a better hold of the painting.

Figure 9:
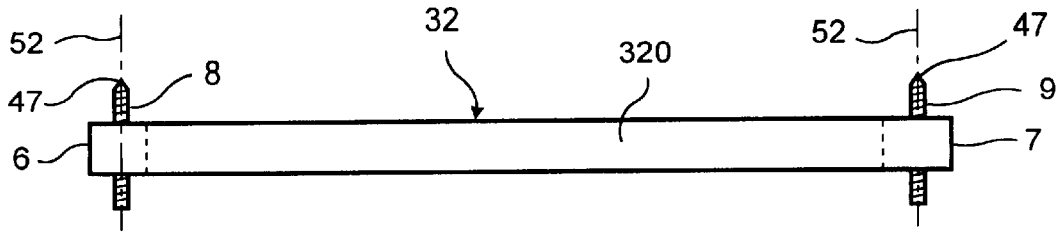
FIG. 9 is a front view of the device according to the invention in a second variant embodiment.

FIG. 9 shows the supporting and positioning device according to the invention in another variant embodiment, in which the fixing elements 6, 7 are joined in a single fixing element 32 of elongated shape; the two positioning and supporting elements 8, 9 are mounted mobile on a bar 320 of this fixing element 32, and are adjustable in height with respect to this fixing element 32.

Figure 10:
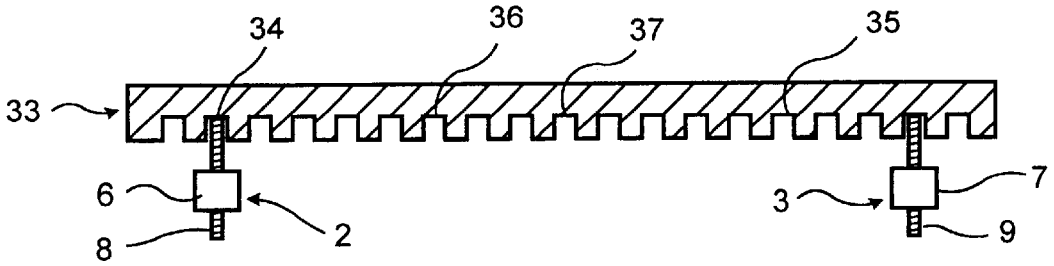
FIG. 10 is a front view in partial section of a rule used for hanging a device in accordance with a variant embodiment of the invention.

FIG. 10 shows the supporting and positioning device in a variant embodiment in which it comprises a removable adjusting element which is a rectilinear positioning rule 33 of rectangular section, provided on a lower face with housings 34, 35, 36, 37 of the same depth, for the insertion of the upper ends of the threaded rods 20, 21, so as to be able to adapt the spacing of the fixing elements 6, 7 to different dimensions of paintings, these housings being regularly spaced apart.

The presence of the housings 34, 35, 36, 37 makes it possible to adapt to different spacings of the fixing elements 6, 7. The length of the rectilinear rule 33 makes it possible to visualize the horizontality easily. The rule 33 is then removed and the frame 4 of the painting is deposited on the positioning and supporting elements 8, 9.

The housings 34, 35, 36, 37 are preferably bored, so that the threaded rods 20, 21 can be screwed therein. In that case, it suffices, when the fixing elements 6, 7 are fixed on the wall 1, to hold the rule 33 in order to maintain the supporting members 2, 3 in place. After having fixed the fixing elements 6, 7, the threaded rods 20, 21 are unscrewed in order to be able to withdraw the positioning rule 33; a slight defect in horizontality will be compensated by screwing or if screwing the rods 20, 21.

Figure 21:
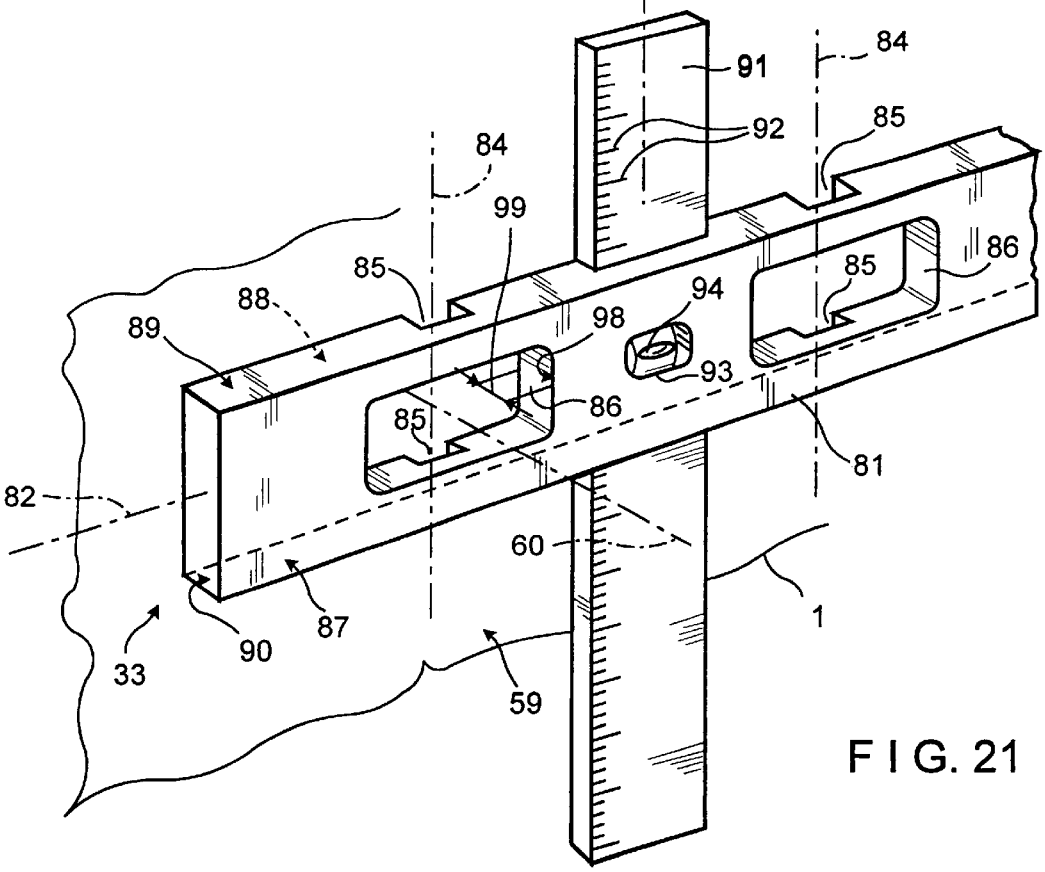
FIGS. 21 and 22 schematically illustrate two variant embodiments of a rule serving as tool for hanging a painting support device in accordance with one of FIGS. 2 to 5, or 17 or 20.

The rule 33 might, in a variant, be further equipped with a level 93 with bubble 94 (as illustrated in FIG. 21) intended to visualize even more easily the horizontality of the rule 33.

Figure 11:
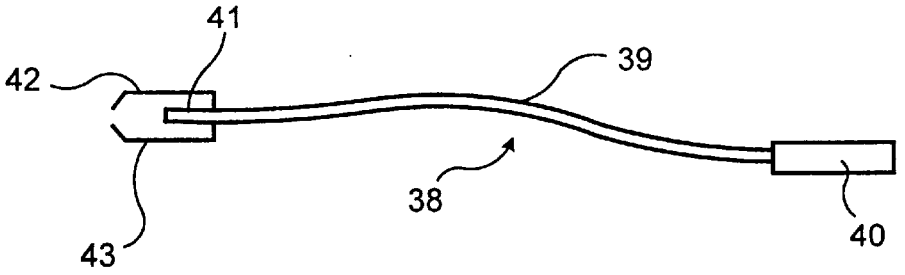
FIG. 11 is a front view of an adjusting tool adapted to the positioning and adjustment of the devices of FIGS. 1 to 9 in particular.

Positioning and adjustment of the painting supporting and positioning device are facilitated by the use of an adjusting tool 38 described with reference to FIGS. 11 and 19, which comprises an elongated rod 39, which is advantageously made of flexible material, provided at one of its ends with a handle 40, and at another end with an actuation means 41 (for example a screwdriver blade) complementary of the actuation means (impression) of the positioning and supporting elements 8, 9.

Tool 38 also comprises elastic jaws 42, 43 intended to maintain the blade 41 of the adjusting tool 38 and the impression of the head 49 of the screw 20, 21, temporarily in mesh with one another.

The adjusting tool 38 with elongated rod 39 makes it possible to displace the supporting element forming bracket vertically by screwing and unscrewing, while the frame of the painting is already in place. In fact, due to the length of the rod 39, the handle 40 projects below the painting (FIG. 19), and may be actuated in rotation (380, FIG. 19) and in translation (381, FIG. 19).

In this way, each positioning and supporting element 8, 9 may firstly be positioned in height, by rotation of the handle 40. The user also has the possibility of assessing the position of the painting by moving back a few steps, then of firther regulating adjustment of the device if necessary.

It is then easy to withdraw the adjusting tool 38, by simple traction, so as to open the elastic jaws 42, 43 and disconnect the blade 41 from the head 49 of screws 20, 21.

Figure 12:
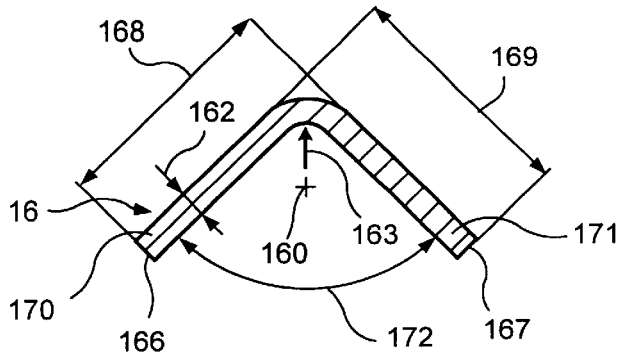
FIGS. 12 to 15A illustrate four embodiments of blades in accordance with one of the aspects of the invention and serving as member for fixing an object on a wall, which blades may come within the constitution of the devices for hanging a painting as describe in FIGS. 1 to 10 and 16 to 20.
Figure 12A:
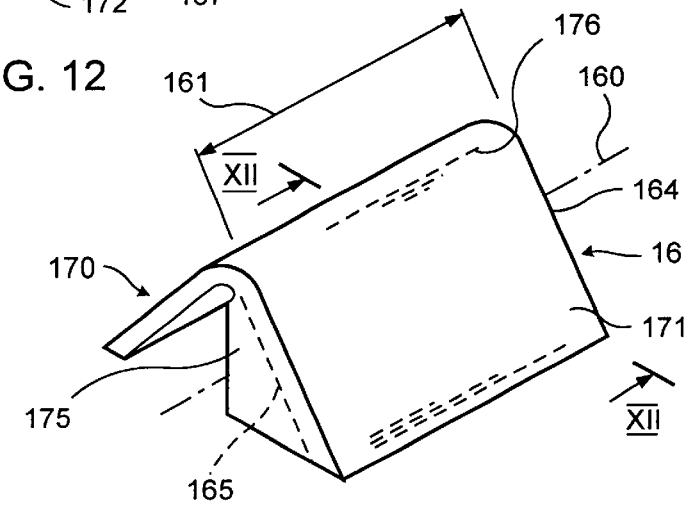
Figure 13:
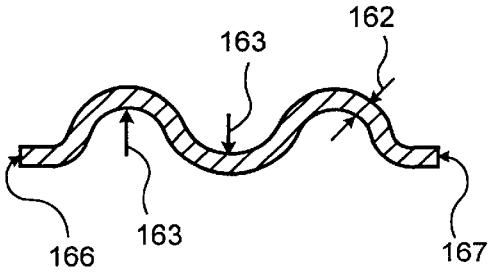
Figure 13A:
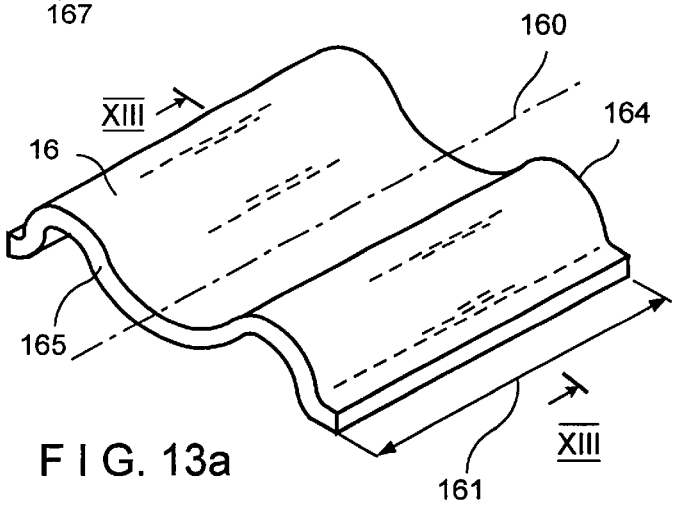
Figure 14:
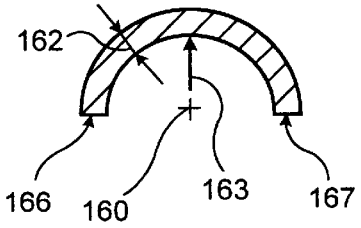
Figure 14A:
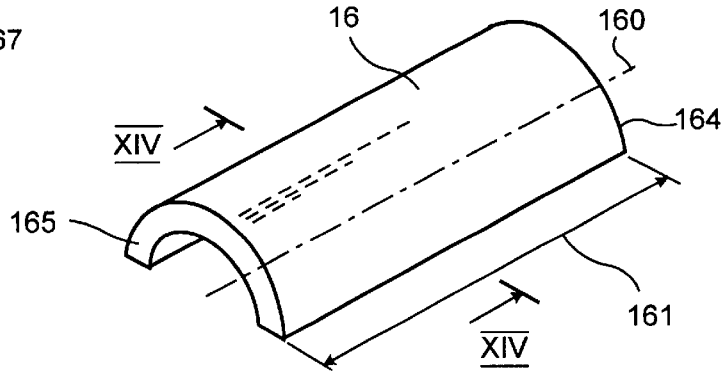
Figure 15:
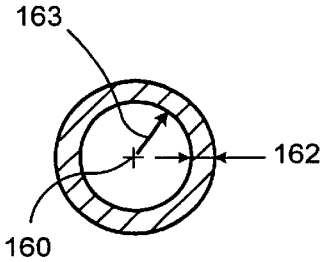
Figure 15A:
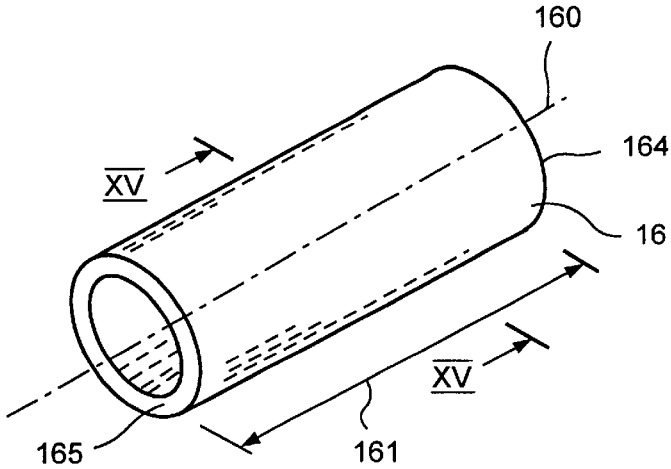

With reference to FIGS. 12 to 15A, a metal blade 16 according to the invention extends along a longitudinal axis 160 and is given a length 161 for example of the order of 20 to 30 mm; the blade illustrated in FIGS. 12 and 12A is obtained by cutting out a metal foil of thickness 162 for example close to 3 tenths of a millimeter, which is bent along a line parallel to the longitudinal axis 160, along a radius of curvature 163, for example of the order of 2 to 3 mm, so as to define two ribs 170 and 171 having ends 166 and 167 respectively. The ribs are of widths (168, 169 respectively, see FIG. 12) for example of the order of 3 to 5 mmn; the angle 172 of bend may in particular be close to 90°; the blades illustrated in FIGS. 13 to 15A may be obtained by bending or roll-bending or rolling portions (for example of rectangular shape) of hardened steel sheet, to form as illustrated in FIGS. 13 and 13A, a blade of regularly undulating shape in its transverse section, or as illustrated in FIG. 14, a blade in the form of a portion of cylinder of axis 160 and of radius equal to the radius of curvature 163 of the blade; in the case of the blade illustrated in FIGS. 15 and 15A, one is face to face with a blade of tubular shape of axis 160, of internal radius equal to the radius of curvature 163 and of thickness 162 equal to the thickness of the blade.

Figure 16:
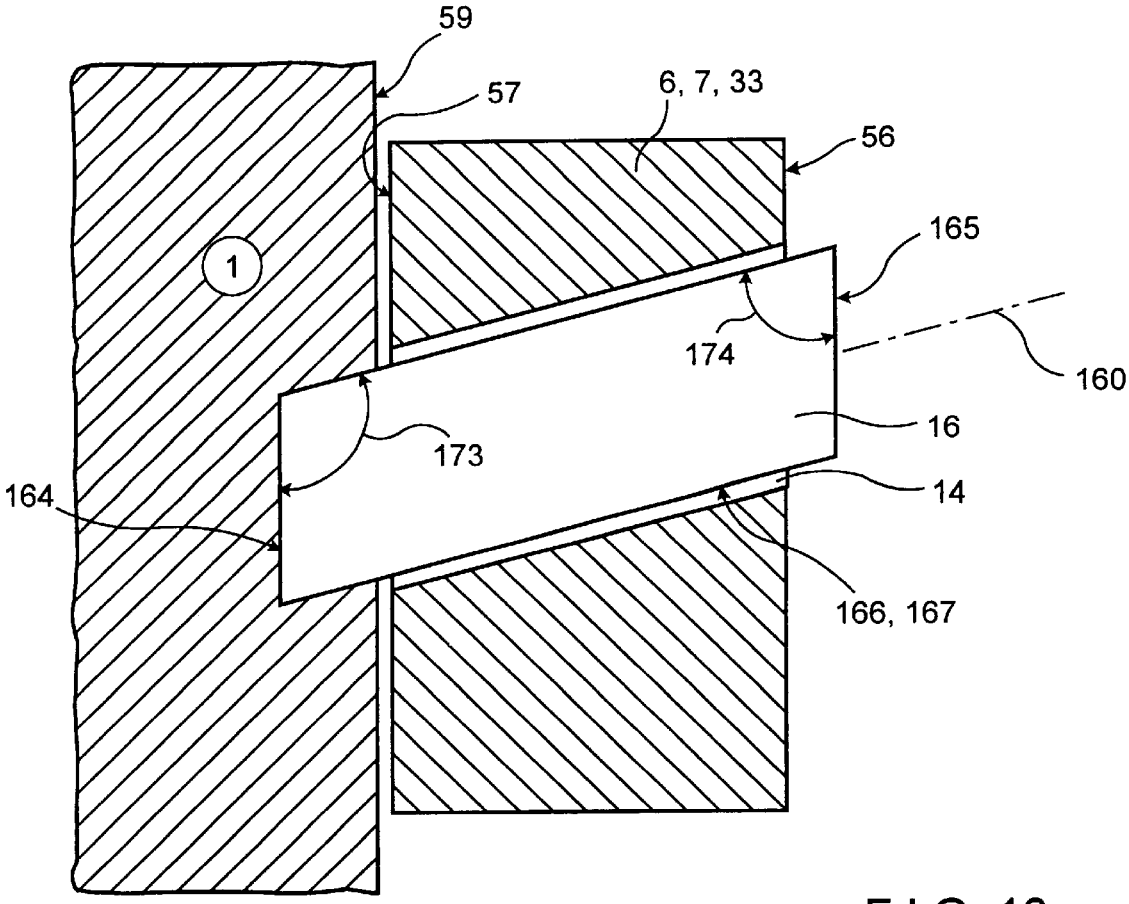
FIG. 16 illustrates in a view in section through a vertical plane a mode of using a blade according one of FIGS. 12 to 15A to fix a module or part 6, 7, 33 adapted to support an object such as a frame.

With reference to FIG. 16 illustrating the use of one of the blades as shown in particular in FIGS. 12 to 15A, it is seen that the penetration of the blade 16 along its longitudinal axis 160 in a surface 1 of which the face 59 is substantially vertical, is preferably effected with the aid of a body 6, 7, 33 forming part either of a tool for hanging the blade, or of an object to be fixed with the aid of said blade 16; the blade may slide in a cylindrical slot 14 provided in the body 6, 7, 33 of which the transverse section follows the transverse section of the blade, and inside which the latter can slide during its penetration by impacting (with the aid of a hammer) applied on a front edge 165 of one of its longitudinal ends; the rear edge 164 of its second longitudinal end penetrating in the surface 1, perforating it under the effect of the shocks applied, and thanks to the small thickness of said blade which in particular does not need to be bevelled; as illustrated in FIG. 16, the angles of cut 173, 174 of the rear (164) and front (165) end edges are preferably supplementary, and respectively for example close to 110° and 70° about, with the result that the longitudinal axis 160 of the blade 16 as well as the slot 14 provided in the block 6 are inclined with respect to the normal to the surface by an angle (reference 44, FIGS. 4 and 19) close to 20° C.

By way of example, a block fixed by four nails and two V-blades as shown in FIGS. 12 and 12*a,* which blades have a width flat (corresponding to the sum of the widths 168 and 169 of the two ribs, see FIG. 12) of the order of 13 mm, a thickness of 0.3 mm, which are driven by 8 mm in a plaster surface, makes it possible to support a load of about 15 kg.

In an embodiment illustrated in FIG. 12*a,* the rib 171 is extended by a 90° fold 175; the fold 175 is effected along a front edge 165 of the blade and of the rib 171, and extends in a plane perpendicular to the axis 160; this fold 175 makes it possible, when the blade is driven in a surface, to retain the body (references 6, 7, 33, FIG. 16 in particular) that it fixes to the surface, serving as stop.

Finally, in certain cases, the blade may be used alone and advantageously replace a nail, a screw, an eye bolt, or a hook.

In that case, the part which will have served for guiding the blade during the phase of penetration in the wall will be withdrawn. The emerging part of the blade will be used for fixing objects such as for example the cord which serves to hang a painting. In that case, the upwardly inclined position of the blade, or a positive angle, will increase the stability of hooking of the cord resting on the zone of longitudinal fold (176, FIG. 12A) of the blade projecting on the wall.

FIGS. 17 to 20 illustrate a preferred embodiment of a device for supporting an object such as a painting and its use for fixing the object to the vertical surface 1, with reference in particular to these Figures, the screw 20, 21 is provided at its lower end with a head 49 comprising an impression 48 for example with 6 hollow sides, for drive thereof by a screwdriver 38 provided with a stipple, long rod 39 terminating at one end by the handle 40, and terminating at its second end by a head 390 provided, on the one hand with a blade 41 of shape complementary of the impression 48 provided in the head 49 of the screw, and furthermore provided with jaws 42, 43 or flexible and/or elastic fingers (for example made of plastics material) which extend from said head 390 and which are provided near their free end and on an internal part thereof, with inclined ramps 74 and 75; ramp 74 facilitates (during a movement of approach of the bead 390 of the tool with respect to the head 49 of the screw), spacing apart of the arms 42, 43 with the result that the latter may slide about the head 49 until they tighten above the head 49 whose diameter is greater than the diameter of the central part 50, to tighten the head of the screw and make it possible to hold the tool in position suspended from the head by its said fingers or jaws; ramps 75 facilitate spacing apart of the jaws and disconnection of the tool with respect to the screw 20, 21 during a traction in the direction of arrow 381 on the handle 40 of the screw driver 38.

The block 6, 7 or body forming an intermediate support of the painting is preferably in the form of cylinder of rectangular section, of axis 600 inclined with respect to the bases constituting the rear (57) and front (56) faces, parallel to each other, of the block; the block comprises four through holes 10 whose axes are parallel to the axis 600 of the block, and comprises two slots 14 and 15 allowing the slide of two blades such as those illustrated in FIGS. 12A and 12B, for fixing the block to the surface 1.

Figure 18:
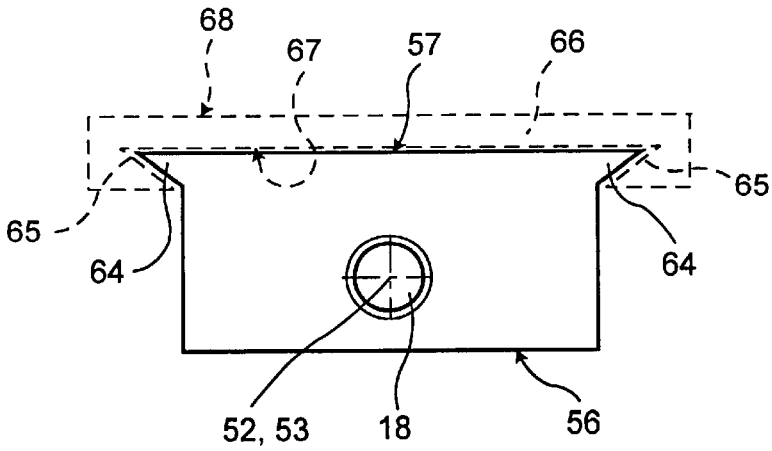
FIGS. 18 and 20 respectively illustrate in plane view and in perspective view another embodiment of a painting support device which integrates an adapter in the form of a shoe.
Figure 20:
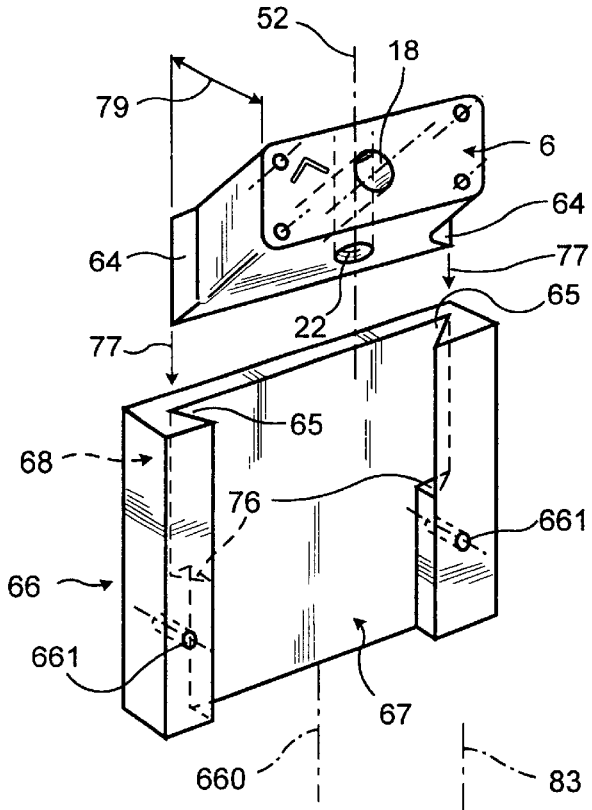

Said block 6, 7 is thus limited by an upper surface 72 and a lower surface 71 parallel to angle 600 and inclined by angle 44, and is limited furthermore by lateral faces 603 and 604; in the vicinity of the rear face 57, the lateral walls 603 and 604 are flared and define two prominent parts 64 in the form of a lug extending along an axis parallel to axis 52 of the screw 20, 21; as illustrated in FIGS. 18 and 20, these lugs allow the slide of the block 6, 7 in slideways 65 provided in an adapter or intermediate support 66 in the form of a shoe adapted to serve as receptacle for the block 6, 7; to that end, the lugs or lips 64 cooperating with the female slideways 65 (in dove-tail form) extending along axis 660 of the adapter 66, allow the relative slide (in the direction of arrow 77) of the two parts up to a stop 76 serving as stop for the part 6; in this way, the adapter block 66 of which the surface of the rear face 68 is notably greater thaii the surface of the front and rear (57 and 56) faces of the block 6, may be fixed to the wall by said rear face 68 provided with an adhesive, as well as by fixing accessories such as nails extending through orifices 661 provided in the adapter 66; said adapter is of flattened shape and comprises a front face 67 parallel to the rear face 68 for fixing the adapter to the wall; the adapter may thus support the block 6.

With reference to FIG. 17, the upper end 51 of the screw 20, 21 comprises a point or elongated element 510 along axis 52 of the screw, terminating in a tip 47 on which rests the face 45 of the crossbeam 5 of the painting.

With reference to FIG. 19, the device according to the invention is used to suspend an object which comprises on its rear face 690 a recess or cavity 692 inside which may extend the block 6, 7 and the supporting and adjusting screw 20, 21; in the case of a painting 69, this recess 692 results from the presence of the crossbeams 5, 401 of the frame, which are prominent with respect to said rear face 690 by a value which must be at least slightly greater than the distance between the axis 52 of the screws 20 and 21 and the extension of the front face 56 of the parts 6 and 7, for example at least equal to the thickness (reference 79, FIG. 20) of the block, which is preferably of the order of 10 to 20 mm.

With reference to FIG. 21, the tool for hanging and assisting fixation of a flat object such as a painting against a surface by fixing means such as nails, screws or blades, comprises a first bar 81 extending along a longitudinal axis 82, and a second bar 91 extending along a longitudinal axis 83 perpendicular to said axis 82, and mounted to slide along its longitudinal axis 83 with respect to said first bar and comprising graduations 92 for measuring distance; the first bar comprises:

- a substantially flat rear face 88 adapted to be applied against the outer face (referenced 59, FIG. 19) of said surface,
- a plurality of first cavities 86, for example regularly spaced along the bar, adapted to receive at least a part of an intermediate element 6, 7 for fixing the painting, and of a thickness or depth 99 such that said body 6, 7 may be housed at least partly in said first cavity with its rear face substantially flush with the rear face 88 of the first bar; the first cavity 86 opens out on a front face 87 of the first bar via an orifice 98 allowing free passage and slide of said means 12, 13, 16, 17, 19 for fixing the body, for impaction thereof in said surface.

The bar 81 comprises a plurality of second cavities 85 adapted to receive an element 8, 9 for positioning and supporting the painting, which is screwed in said intermediate fixing element 6, 7; the second cavity communicates with said first cavity and preferably extends along a longitudinal axis 84 perpendicular to said longitudinal axis 82 of the first bar, which second cavity 85 opens out on a lower face 90 as well as on an upper face 89 of said first bar.

Figure 22:
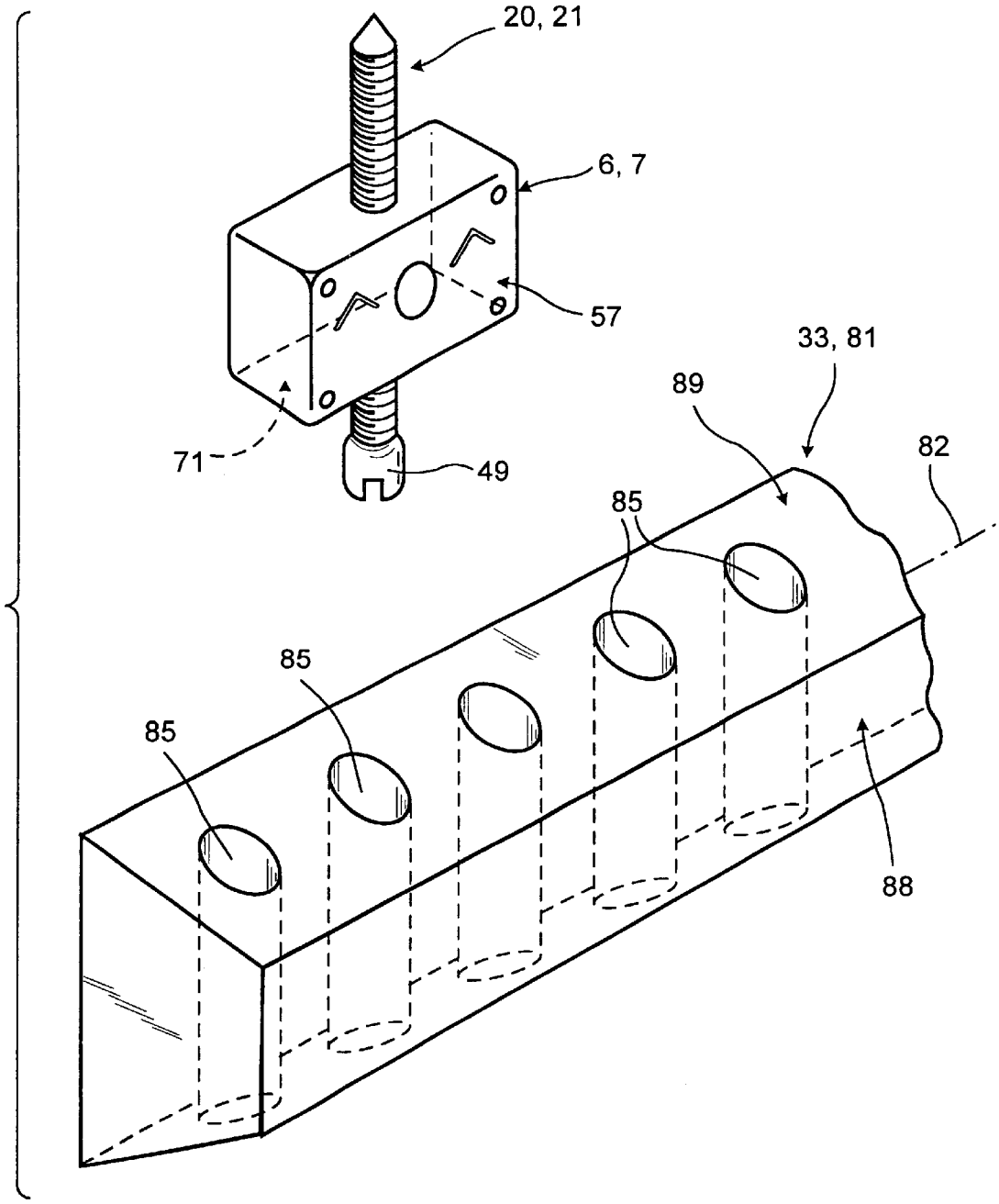

In a simplified embodiment illustrated in FIG. 22, the bar 81 extending along its axis 82 (which is horizontal in position of use) comprises only cylindrical through cavities 85, of vertical axis and of section following the section of a head 49 of an adjusting screw; the upper face 89 of the bar is inclined so that the body 6, 7, resting by its lower face 71 on the face 89, has its rear face 57 applied against the surface when the rear face 88 of the bar is also applied against this surface.

The tools illustrated in FIGS. 10, 21 and 22 facilitate hold of the devices by the user during penetration of the nails or blades, and also facilitate positioning of the supports at the places desired for fixation to the surface.

What is claimed is:

1. An apparatus for hanging an object on a substantially vertical surface, said object comprising a surface that protrudes from an upper end of a face of the object, said apparatus including at least one article comprising:

(a) a body having a threaded passage that passes through the body;

(b) means for fixing the body to the substantially vertical surface;

(c) bracket means for supporting the protruding surface, wherein the bracket means comprises a bracket element with a single tip that tapers to a point, whereby the bracket element is able to make point contact with the protruding surface;

(d) threaded displacement means insertable in the passage and movable with respect to the body for displacement of the bracket means relative to the body and for supporting the bracket means relative to the body in any of a plurality of positions with the displacement means inserted in the passage, said displacement means comprising a first end that projects from the passage at a top face of the body and a second end that projects from the passage at a bottom face of the body with the displacement means inserted in tide passage, said first end comprising said bracket means.

2. An apparatus according to claim 1, wherein said fixing means comprises at least one through hole or slot extending between a front face and a rear face of the body for receiving a curved blade comprising a portion of bent or rolled metal plate, said through hole or slot being substantially cylindrical.

3. An apparatus according to claim 1, wherein said fixing means comprises a plurality of holes or slots that are inclined with respect to the normal to a rear face of the body by an angle between 5 and 45 degrees, said plurality of holes or slots being parallel to one another.

4. An apparatus according to claim 1, wherein the article comprises an intermediate fixing body or base with an adhesive face for abutment against said substantially vertical surface, said face being integral with said intermediate fixing body or base.

5. An apparatus according to claim 1, wherein the fixing means comprises a base or adapter of flattened form, said base or adapter comprising means for connecting said body to said base or adapter, said base or adapter comprising adhesive means on a rear face thereof for adhering to the substantially vertical surface.

6. An apparatus according to claim 1, wherein said body comprises a plastic material and said displacement means comprises a plastic or metal screw, said body further comprising: (i) first housing means, comprising at least first and second substantially cylindrical houses, for receiving a tack or nail; (ii) second housing means, comprising at least two housings, for receiving a fixing blade and (iii) third housing means, comprising at least one housing, for receiving the head of a fixing screw.

7. An apparatus according to claim 1, wherein the bracket means has a generally planar surface for supporting the protruding surface.

8. An apparatus according to claim 1, wherein the fixing means comprises an adapter with slide means for slidable engagement of the adapter and the body, said adapter comprising orifice means for insertion of a member that fixes the adapter to the substantially vertical surface.

9. An apparatus according to claim 1, wherein the fixing means comprises at least two blades, said at least two blades having identical cross sections and different lengths or having identical shapes and different widths.

10. An apparatus according to claim 1, further comprising a removable, positioning rule comprising an upper face and a lower face, said lower face comprising a plurality of housing means for receiving the tip.

11. An apparatus according to claim 1 further comprising tool for adjustment of the disposition of the displacement means relative to the body, said tool comprising an elongate body portion, a first end and a second end comprising means for actuating said displacement means to effect said adjustment.

12. An apparatus according to claim 11, wherein the second end of the displacement means comprises an impression for receiving a screwdriver blade and the means for actuating comprises a screwdriver blade for insertion into the impression and jaw means for maintaining the screwdriver blade in the impression to effect said adjustment.

13. A method for hanging an object on a substantially vertical surface, said object comprising a surface that protrudes from an upper end of a face of the object, said method comprising:

(a) providing at least first and second articles each comprising (i) a body having a threaded passage that passes through the body and (ii) threaded adjustment means inserted into the threaded passage and movable with respect to the body for displacement of the protruding surface relative to the body and for supporting the protruding surface relative to the body in any of a plurality of positions, said adjustment means comprising a first end that protrudes from a top face of the body and a second end that protrudes from a bottom face of the body;

(b) affixing the at least first and second bodies to the substantially vertical surface with the first and second articles in spaced relation in a substantially horizontal alignment;

(c) resting the protruding surface of the object on the respective first ends of the adjustment means of the first and second articles; and (d) adjusting the adjustment means of at least the first of said articles to raise or lower the protruding surface relative to the body.

14. An apparatus for hanging an object on a substantially vertical surface, said object comprising a surface that protrudes from an upper end of a face of the object, said apparatus including at least one article comprising:

(a) a body having a threaded passage that passes through the body;

(b) means for fixing the body to the substantially vertical surface, wherein said fixing means comprises a plurality of holes or slots that are inclined with respect to the normal to a rear face of the body by an angle between 5 and 45 degrees, said plurality of holes or slots being parallel to one another;

(c) bracket means for supporting the protruding surface;

(d) threaded displacement means insertable in the passage and movable with respect to the body for displacement of the bracket means relative to the body and for supporting the bracket means relative to the body in any of a plurality of positions with the displacement means inserted in the passage, said displacement means comprising a first end that projects from the passage at a top face of the body and a second end that projects from the passage at a bottom face of the body with the displacement means inserted in the passage, said first end comprising said bracket means.

15. An apparatus according to claim 14, wherein said fixing means comprises at least one through hole or slot extending between a front face and a rear face of the body for receiving a curved blade comprising a portion of bent or rolled metal plate, said through hole or slot being substantially cylindrical.

16. An apparatus according to claim 14, wherein the article comprises an intermediate fixing body or base with an adhesive face for abutment against said substantially vertical surface, said face being integral with said intermediate fixing body or base.

17. An apparatus for hanging an object on a substantially vertical surface, said object comprising a surface that protrudes from an upper end of a face of the object, said apparatus including at least one article comprising:

(a) a body having a threaded passage that passes through the body;

(b) means for fixing the body to the substantially vertical surface;

(c) bracket means for supporting the protruding surface, said bracket means having a generally planar surface for supporting the protruding surface;

(d) threaded displacement means insertable in the passage and movable with respect to the body for displacement of the bracket means relative to the body and for supporting the bracket means relative to the body in any of a plurality of positions with the displacement means inserted in the passage, said displacement means comprising a first end that projects from the passage at a top face of the body and a second end that projects from the passage at a bottom face of the body with the displacement means inserted in the passage, said first end comprising said bracket means.

18. An apparatus according to claim 17, wherein said fixing means comprises at least one through hole or slot extending between a front face and a rear face of the body for receiving a curved blade comprising a portion of bent or rolled metal plate, said through hole or slot being substantially cylindrical.

19. An apparatus according to claim 17, wherein the article comprises an intermediate fixing body or base with an adhesive face for abutment against said substantially vertical surface, said face being integral with said intermediate fixing body or base.

* * * * *